US011333090B2

(12) United States Patent
Miyabe

(10) Patent No.: US 11,333,090 B2
(45) Date of Patent: May 17, 2022

(54) EVAPORATED FUEL PROCESSING DEVICE

(71) Applicant: AISAN KOGYO KABUSHIKI KAISHA, Obu (JP)

(72) Inventor: Yoshikazu Miyabe, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/391,236

(22) Filed: Aug. 2, 2021

(65) Prior Publication Data

US 2022/0042468 A1 Feb. 10, 2022

(30) Foreign Application Priority Data

Aug. 5, 2020 (JP) ..... JP2020-133325

(51) Int. Cl.
*F02D 41/00* (2006.01)
*F02D 41/22* (2006.01)

(52) U.S. Cl.
CPC ..... *F02D 41/003* (2013.01); *F02D 41/222* (2013.01); *F02D 2041/223* (2013.01); *F02D 2200/0602* (2013.01)

(58) Field of Classification Search
CPC ..... F02D 41/003; F02D 41/222; F02D 2041/223; F02D 2200/0602
See application file for complete search history.

(56) References Cited

U.S. PATENT DOCUMENTS 10,054,070 B2 * 8/2018 Dudar ..... F02D 41/0037
10,550,775 B2 2/2020 Miyabe et al.
10,718,280 B2 7/2020 Fukui et al.
10,851,722 B2 12/2020 Fukui et al.
2015/0101327 A1 * 4/2015 Clark ..... F02D 41/144 60/599
2015/0114361 A1 * 4/2015 Matsunaga ..... F02M 25/089 123/520
2015/0121864 A1 * 5/2015 Surnilla ..... F02D 41/005 123/568.21

(Continued)

FOREIGN PATENT DOCUMENTS

JP 6336605 B2 6/2018
JP 6588357 B2 10/2019
JP 6612729 B2 11/2019

*Primary Examiner* — Joseph J Dallo

(74) *Attorney, Agent, or Firm* — Shumaker, Loop & Kendrick, LLP

(57) ABSTRACT

An evaporated fuel processing device that includes a pressurizing pump configured to pressurize gas in the vapor passage downstream of the closing valve toward the closing valve; a first pressure sensor configured to detect a pressure in the fuel tank directly or indirectly, and/or a second pressure sensor configured to detect a pressure in the vapor passage downstream of the closing valve directly or indirectly. When the closing valve moves toward an open side in the closed state with the pressurizing pump pressurizing the gas in the vapor passage downstream of the closing valve toward the closing valve, the controller may specify a valve-opening-start position based on the pressure detected by the first pressure sensor and/or the pressure detected by the second pressure sensor, wherein the valve-opening-start position is a position where the closing valve transitions from the closed state to the opened state.

5 Claims, 8 Drawing Sheets

(56) References Cited

U.S. PATENT DOCUMENTS

| | | | | |
|---|---|---|---|---|
| 2015/0275806 | A1* | 10/2015 | Genslak | F02D 41/1401 701/104 |
| 2015/0292428 | A1* | 10/2015 | Hakeem | F02D 41/144 701/104 |
| 2016/0097355 | A1* | 4/2016 | Jentz | F01M 13/021 701/102 |
| 2016/0177882 | A1* | 6/2016 | Dudar | F02D 41/2406 701/22 |
| 2016/0230681 | A1* | 8/2016 | Tanaka | F02M 25/0854 |
| 2018/0066595 | A1* | 3/2018 | Dudar | F02M 25/0818 |

* cited by examiner

EVAPORATED FUEL PROCESSING DEVICE

CROSS-REFERENCE TO RELATED APPLICATION

This application claims priority to Japanese Patent Application No. 2020-133325, filed on Aug. 5, 2020, the entire contents of which are incorporated herein by reference.

TECHNICAL FIELD

The art disclosed herein relates to an evaporated fuel processing device.

BACKGROUND

Japanese Patent No. 6588357 describes an evaporated fuel processing device. The evaporated fuel processing device of Japanese Patent No. 6588357 includes a fuel tank, a vapor passage through which evaporated fuel generated from fuel in the fuel tank flows, a closing valve configured to open and close the vapor passage, a canister in which the evaporated fuel that has flowed through the vaper passage is adsorbed, and a controller. In the evaporated fuel processing device of Japanese Patent No. 6588357, the controller changes the axial distance between a valve body and a valve seat from the state in which the closing valve is completely closed and learns the valve-opening-start position of the closing valve based on changes in internal pressures in the fuel tank and in the canister in response to the change in the axial distance.

SUMMARY

In the evaporated fuel processing device, evaporated fuel in the vapor passage may flow from a portion of the vapor passage upstream of the closing valve (on fuel tank side) into a portion of the vapor passage downstream of the closing valve when the closing valve opens in learning the valve-opening-start position of the closing valve. Then, the evaporated fuel is adsorbed by an adsorbent in the canister, and the adsorbing capacity may thereby be decreased. In view of this, the disclosure herein provides a technique that makes it possible to reduce an outflow of evaporated fuel when a valve-opening-start position is specified.

An evaporated fuel processing device disclosed herein may comprise a fuel tank; a vapor passage through which evaporated fuel generated from fuel in the fuel tank flows; a closing valve configured to open and close the vapor passage; a pressurizing pump configured to pressurize gas in the vapor passage downstream of the closing valve toward the closing valve; a first pressure sensor configured to detect a pressure in the fuel tank directly or indirectly; and/or a second pressure sensor configured to detect a pressure in the vapor passage downstream of the closing valve directly or indirectly; and a controller. Gas in the vapor passage may flow through the closing valve when the closing valve is in an opened state, and the gas in the vapor passage may not flow through the closing valve when the closing valve is in a closed state. When the closing valve moves toward an open side in the closed state with the pressurizing pump pressurizing the gas in the vapor passage downstream of the closing valve toward the closing valve, the controller may specify a valve-opening-start position based on the pressure detected by the first pressure sensor and/or the pressure detected by the second pressure sensor, wherein the valve-opening-start position is a position where the closing valve transitions from the closed state to the opened state.

DETAILED DESCRIPTION

Figure 1:
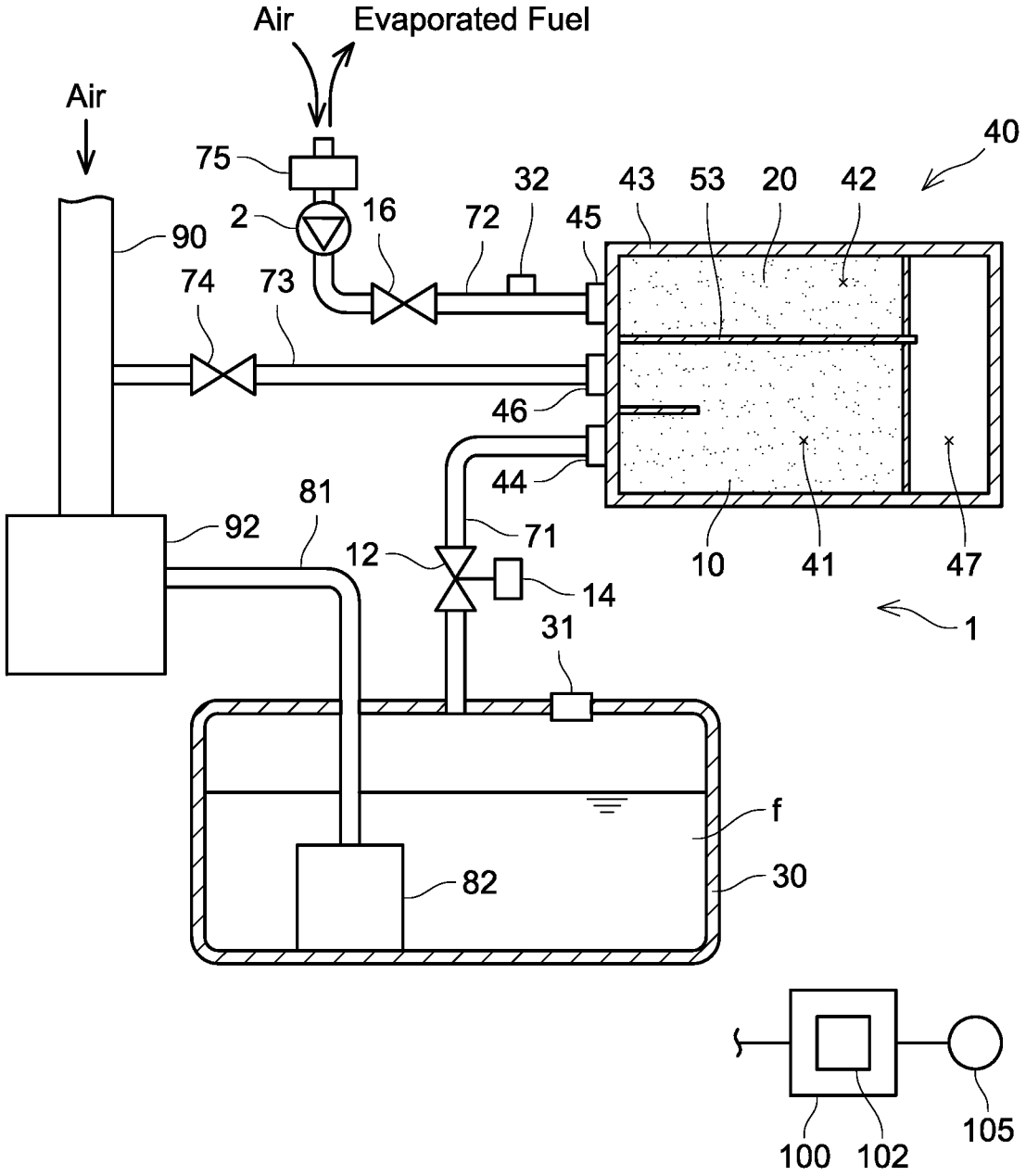
FIG. 1 schematically shows an evaporated fuel processing device according to an embodiment.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved evaporated fuel processing devices, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

An evaporated fuel processing device disclosed herein may comprise a fuel tank; a vapor passage through which evaporated fuel generated from fuel in the fuel tank flows;

a closing valve configured to open and close the vapor passage; a pressurizing pump configured to pressurize gas in the vapor passage downstream of the closing valve toward the closing valve; a first pressure sensor configured to detect a pressure in the fuel tank directly or indirectly; and/or a second pressure sensor configured to detect a pressure in the vapor passage downstream of the closing valve directly or indirectly; and a controller. Gas in the vapor passage may flow through the closing valve when the closing valve is in an opened state, and the gas in the vapor passage may not flow through the closing valve when the closing valve is in a closed state. When the closing valve moves toward an open side in the closed state with the pressurizing pump pressurizing the gas in the vapor passage downstream of the closing valve toward the closing valve, the controller may specify a valve-opening-start position based on the pressure detected by the first pressure sensor and/or the pressure detected by the second pressure sensor, wherein the valve-opening-start position is a position where the closing valve transitions from the closed state to the opened state.

When the closing valve transitions from the closed state to the opened state with the pressurizing pump pressurizing the gas in the vapor passage downstream of the closing valve toward the closing valve, the gas in the vapor passage downstream of the closing valve flows through the closing valve into the vapor passage upstream of the closing valve (fuel tank side). As a result, the pressure in the fuel tank is raised and the pressure in the vapor passage downstream of the closing valve is decreased. Thus, in the case where the evaporated fuel processing device comprises the first pressure sensor, the detected pressure by the first pressure sensor is raised. In the case where the evaporated fuel processing device comprises the second pressure sensor, the detected pressure by the second pressure sensor is decreased. In the case where the evaporated fuel processing device comprises the first pressure sensor, the controller specifies the valve-opening-start position based on the detected pressure by the first pressure sensor. In the case where the evaporated fuel processing device comprises the second pressure sensor, the controller specifies the valve-opening-start position based on the detected pressure by the second pressure sensor. Since the pressurizing pump is pressurizing the gas in the vapor passage downstream of the closing valve toward the closing valve when the controller specifies the valve-opening-start position, a flow of the evaporated fuel from the upstream side of the closing valve (fuel tank side) into the downstream side thereof in specifying the valve-opening-start position can be reduced. If an open air valve is disposed on an open air passage connected to the canister, the pressurized gas at the downstream side of the closing valve can be sealed.

The evaporated fuel processing device may comprise the first pressure sensor and the second pressure sensor. The controller may determine whether the first pressure sensor is operating abnormally and/or whether the second pressure sensor is operating abnormally based on the pressure detected by the first pressure sensor and the pressure detected by the second pressure sensor.

According to this configuration, whether the first pressure sensor is operating abnormally and whether the second pressure sensor is operating abnormally can be determined by using the configuration used to specify the valve-opening-start position of the closing valve. For example, when the detected pressure by the second pressure sensor does not decrease despite a rise in the detected pressure by the first pressure sensor upon the transition of the closing valve from the closed state to the opened state, it can be determined that the second pressure sensor is operating abnormally. Whether the first pressure sensor is operating abnormally can be determined similarly.

The evaporated fuel processing device may further comprise a stepping motor configured to actuate the closing valve. The controller may specify the valve-opening-start position of the closing valve based on a number of steps by which the stepping motor has rotated.

According to this configuration, the valve-opening-start position can be accurately specified by specifying it based on the number of steps by which the stepping motor has rotated.

The controller may specify the valve-opening-start position of the closing valve based on a rise rate of the pressure detected by the first pressure sensor and/or a decrease rate of the pressure detected by the second pressure sensor observed when the stepping motor is rotated by a plurality of steps at a time.

According to this configuration, it is possible to make the closing valve reach the valve-opening-start position earlier by rotating the stepping motor by a plurality of steps at a time. In this case as well, the valve-opening-start position can be accurately specified. When the rise rate of the detected pressure by the first pressure sensor is high, it can be determined that the closing valve has reached the valve-opening-start position at one of first-half steps of the plurality of steps. When the rise rate of the detected pressure by the first pressure sensor is low, it can be determined that the closing valve has reached the valve-opening-start position at one of latter-half steps of the plurality of steps. When the decrease rate of the detected pressure by the second pressure sensor is high and when it is low, determination on the valve-opening-start position can be made similarly.

The controller may specify the valve-opening-start position of the closing valve based on the pressure detected by the first pressure sensor and/or the pressure detected by the second pressure sensor observed when the number of steps by which the stepping motor has rotated is decreased by at least one step after the stepping motor has rotated by a plurality of steps at a time.

According to this configuration, it is possible to make the closing valve reach the valve-opening-start position earlier by rotating the stepping motor by a plurality of steps at a time. In this case as well, the valve-opening-start position can be accurately specified.

(Configuration of Evaporated Fuel Processing Device 1)

An evaporated fuel processing device 1 according to an embodiment will be described with reference to the drawings. FIG. 1 schematically shows the evaporated fuel processing device 1 according to the embodiment. As shown in FIG. 1, the evaporated fuel processing device 1 includes a fuel tank 30, a canister 40, and a controller 100. Further, the evaporated fuel processing device 1 also includes a vapor passage 71, an open air passage 72, and a purge passage 73. The evaporated fuel processing device 1 shown in FIG. 1 is mounted in a vehicle such as a gasoline-fueled vehicle or a hybrid vehicle.

The fuel tank 30 is configured to store fuel f such as gasoline. The fuel f is poured into the fuel tank 30 from an inlet (not shown). A fuel pump 82 is disposed in the fuel tank 30. A fuel passage 81 is connected to the fuel pump 82. The fuel pump 82 is configured to discharge the fuel f in the fuel tank 30 to the fuel passage 81. The fuel f discharged into the fuel passage 81 is supplied to an engine 92 of the vehicle through the fuel passage 81.

The fuel f in the fuel tank 30 may evaporate within the fuel tank 30. For example, the fuel f may evaporate while the vehicle in which the evaporated fuel processing device 1 is mounted is traveling. The fuel f may also evaporate during when the vehicle in which the evaporated fuel processing device 1 is mounted is parked. Evaporated fuel is generated in the fuel tank 30 by the fuel f evaporating in the fuel tank 30.

A first pressure sensor 31 is disposed at the fuel tank 30. The first pressure sensor 31 is configured to detect the pressure in the fuel tank 30. When the first pressure sensor 31 detects the pressure in the fuel tank 30, information on the detected pressure is sent to the controller 100. The controller 100 obtains the information on the detected pressure. The pressure in the fuel tank 30 may be increased by the evaporated fuel being generated in the fuel tank 30.

An upstream end of the vapor passage 71 is connected to the fuel tank 30. Gas that contains the evaporated fuel generated in the fuel tank 30 flows into the vapor passage 71. A downstream end of the vapor passage 71 is connected to the canister 40. The gas having flowed through the vapor passage 71 flows into the canister 40. The vapor passage 71 guides the gas containing the evaporated fuel generated in the fuel tank 30 from the fuel tank 30 to the canister 40.

A closing valve 12 is disposed on the vapor passage 71. The closing valve 12 is configured to open and close the vapor passage 71. The closing valve 12 may, for example, be a globe valve, a ball valve, a gate valve, a butterfly valve, or a diaphragm valve. When the closing valve 12 is in an opened state, the gas in the vapor passage 71 flows through the closing valve 12. For example, when the closing valve 12 transitions to the opened state, the gas containing the evaporated fuel generated from the fuel f in the fuel tank 30 flows through the closing valve 12. When the closing valve 12 transitions to a closed state, the gas in the vapor passage 71 does not flow through the closing valve 12. The evaporated fuel processing device 1 is of a so-called fuel vapor-containment type in which the fuel tank 30 is sealed by the closing valve 12.

The closing valve 12 is actuated by a stepping motor 14. The stepping motor 14 is attached to the closing valve 12 and is configured to actuate the closing valve 12. In a variant, the stepping motor 14 may be incorporated in the closing valve 12. The stepping motor 14 causes the closing valve 12 to move to an open side or to a closing side. For example, as the number of steps by which the stepping motor 14 has rotated (which will be termed "the number of steps of the stepping motor 14") increases, the closing valve 12 moves toward the open side. On the other hand, as the number of steps of the stepping motor 14 decreases, the closing valve 12 moves to the closing side. The stepping motor 14 is configured such that its rotation angle changes as the number of steps changes based on pulse signals. The rotation angle per one step of the stepping motor 14 may, for example, be 0.72 degrees. The opening degree of the closing valve 12 corresponds to the number of steps of the stepping motor 14.

Figure 2:
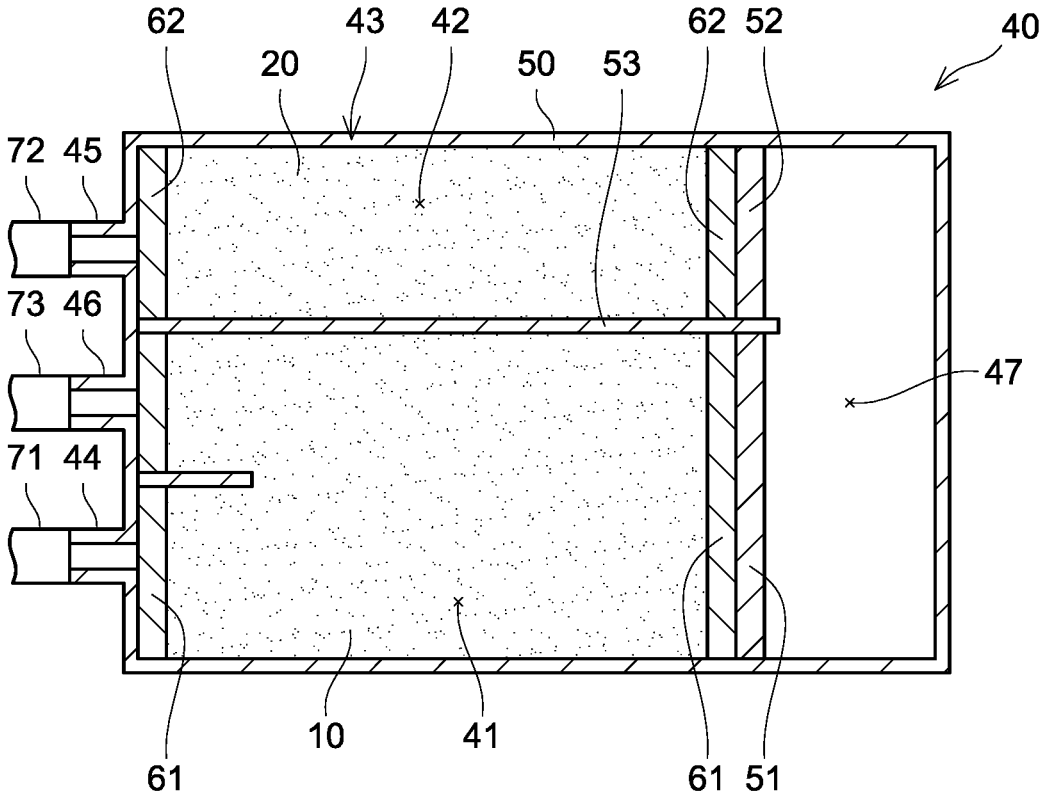
FIG. 2 shows a cross-sectional view of a canister according to the embodiment.

Next, the canister 40 will be described. FIG. 2 is a cross-sectional view of the canister 40. As shown in FIG. 2, the canister 40 includes a casing 43 and a plurality of ports (a tank port 44, an open air port 45, and a purge port 46). The casing 43 and the plurality of ports (the tank port 44, the open air port 45, and the purge port 46) may, for example, be constituted of resin. The casing 43 is integral with the plurality of ports (the tank port 44, the open air port 45, and the purge port 46).

The casing 43 includes a casing body 50 and a partitioning wall 53. The casing body 50 is integral with the partitioning wall 53. The partitioning wall 53 is disposed in the casing body 50 and partitions a space inside the casing body 50. A first chamber 41 and a second chamber 42 are defined within the casing body 50 by the space in the casing body 50 being partitioned by the partitioning wall 53. A first adsorbent 10 is housed in the first chamber 41. A second adsorbent 20 is housed in the second chamber 42.

The first chamber 41 is located upstream of (on the fuel tank 30 side relative to) the second chamber 42 (see FIG. 1). A first porous plate 51 and a pair of first filters 61 are disposed in the first chamber 41. The first porous plate 51 is arranged at a downstream end of the first chamber 41. A plurality of pores (not shown) is formed in the first porous plate 51. Gas flowing in the first chamber 41 flows through the plurality of pores formed in the first porous plate 51. The first filters 61 are arranged at upstream and downstream ends of the first chamber 41, respectively. The first adsorbent 10 is interposed between the pair of first filters 61. The first filters 61 are configured to remove foreign matters contained in the gas flowing in the first chamber 41.

The first adsorbent 10 in the first chamber 41 is constituted of active carbon, for example. The active carbon constituting the first adsorbent 10 has an ability to adsorb the evaporated fuel. While the gas containing the evaporated fuel is flowing through the first adsorbent 10, a part of the evaporated fuel in the gas is adsorbed by the active carbon. Further, while air is flowing through the first adsorbent 10, the evaporated fuel adsorbed on the active carbon is desorbed into the air from the active carbon (i.e., the evaporated fuel is purged). The active carbon may, for example, be in the form of pellets or monolith. Granulated carbon or crushed carbon may be used as the active carbon, for example. Coal-based or wood-based active carbon may be used as the active carbon, for example. In a variant, the first adsorbent 10 may be constituted of a porous metal complex.

The second chamber 42 is located downstream of (on the opposite side from the fuel tank 30 (open air side) relative to) the first chamber 41 (see FIG. 1). A second porous plate 52 and a pair of second filters 62 are disposed in the second chamber 42. The second porous plate 52 is arranged at an upstream end of the second chamber 42. A plurality of pores (not shown) is formed in the second porous plate 52. Gas flowing in the second chamber 42 flows through the plurality of pores formed in the second porous plate 52. The second filters 62 are arranged at upstream and downstream ends of the second chamber 42, respectively. The second adsorbent 20 is interposed between the pair of second filters 62. The second filters 62 are configured to remove foreign matters contained in the gas flowing in the second chamber 42.

The second adsorbent 20 in the second chamber 42 is constituted of a porous metal complex, for example. The porous metal complex constituting the second adsorbent 20 has an ability to adsorb the evaporated fuel. While the gas containing the evaporated fuel is flowing through the second adsorbent 20, a part of the evaporated fuel in the gas is adsorbed by the porous metal complex. Further, while air is flowing through the second adsorbent 20, the evaporated fuel adsorbed on the porous metal complex is desorbed into the air from the porous metal complex (i.e., the evaporated fuel is purged). For example, the porous metal complex may be in the form of pellets or monolith, or may be in the form of a thin film in which the porous metal complex is applied on a substrate with air permeability. In a variant, the second adsorbent 20 may be constituted of active carbon.

An intermediate chamber 47 is defined between the first chamber 41 and the second chamber 42. The intermediate chamber 47 is defined in the casing body 50 by the space in the casing body 50 being partitioned by the first porous plate 51 and the second porous plate 52.

The tank port 44 of the canister 40 is located adjacent to the first chamber 41 of the casing 43. The tank port 44 is in communication with the first chamber 41. The downstream end of the vapor passage 71 is connected to the tank port 44. The vapor passage 71 is in communication with the first chamber 41 through the tank port 44. The gas having flowed through the vapor passage 71 flows into the first chamber 41 through the tank port 44.

The open air port 45 of the canister 40 is located adjacent to the second chamber 42 of the casing 43. The open air port 45 is in communication with the second chamber 42. An upstream end of the open air passage 72 is connected to the open air port 45. The second chamber 42 is in communication with the open air passage 72 through the open air port 45. The gas having flowed through the second chamber 42 flows into the open air passage 72 through the open air port 45.

A downstream end of the open air passage 72 is open to open air (see FIG. 1). The gas having flowed through the open air passage 72 is discharged to the open air. When the evaporated fuel is desorbed (which will be described later), air from the open air flows into the open air passage 72 from the downstream end of the open air passage 72. The air having flowed into the open air passage 72 flows through the open air passage 72 into the second chamber 42 of the casing 43 through the open air port 45. An air filter 75 is disposed on the open air passage 72. The air filter 75 is configured to remove foreign matters contained in the air flowing into the open air passage 72.

An open air valve 16, a pressurizing pump 2, and a second pressure sensor 32 are disposed on the open air passage 72. The open air valve 16 is configured to open and close the open air passage 72. The open air valve 16 may, for example, be a globe valve, a ball valve, a gate valve, a butterfly valve, or a diaphragm valve. When the open air valve 16 is in an opened state, gas in the open air passage 72 flows through the open air valve 16. For example, when the open air valve 16 transitions to the opened state, air from the open air flows through the open air valve 16. When the open air valve 16 transitions to a closed state, gas in the open air passage 72 cannot flow through the open air valve 16.

The pressurizing pump 2 is disposed downstream of (on open air side relative to) the open air valve 16. The pressurizing pump 2 is configured to pressurize the gas in the open air passage 72 toward the canister 40. By pressurizing the gas in the open air passage 72, the pressurizing pump 2 indirectly pressurizes the gas in the canister 40, the gas in the purge passage 73, and the gas in the vapor passage 71. When the closing valve 12, which is configured to open and close the vapor passage 71, is in the closed state, the pressurizing pump 2 pressurizes the gas in the vapor passage 71 downstream of the closing valve 12 toward the closing valve 12 (toward the upstream side). The type of the pressurizing pump 2 is not particularly limited.

The second pressure sensor 32 is configured to detect the pressure in the open air passage 72. When the second pressure sensor 32 detects the pressure in the open air passage 72, information on the detected pressure is sent to the controller 100. The controller 100 obtains the information on the detected pressure. The open air passage 72 is in communication with the vapor passage 71 through the canister 40. Thus, the pressure in the open air passage 72 is substantially equal to the pressure in the vapor passage 71. When the closing valve 12 is in the closed state, the pressure in the open air passage 72 is substantially equal to the pressure in the vapor passage 71 downstream of the closing valve 12. By detecting the pressure in the open air passage 72, the second pressure sensor 32 indirectly detects the pressure in the vapor passage 71 (the pressure in the vapor passage 71 downstream of the closing valve 12 when the closing valve 12 is in the closed state).

The purge port 46 of the canister 40 is located adjacent to the first chamber 41 of the casing 43. The purge port 46 is in communication with the first chamber 41. An upstream end of the purge passage 73 is connected to the purge port 46. The first chamber 41 is in communication with the purge passage 73 through the purge port 46. The gas having flowed through the first chamber 41 flows into the purge passage 73 through the purge port 46.

A downstream end of the purge passage 73 is connected to an intake passage 90. The gas having flowed through the purge passage 73 flows into the intake passage 90. A purge valve 74 is disposed on the purge passage 73. The purge valve 74 is configured to open and close the purge passage 73. When the purge valve 74 is in an opened state, gas flows through the purge passage 73. A pump (not shown) may be disposed on the purge passage 73.

An upstream end of the intake passage 90 is open to the open air. Air from the open air flows into the intake passage 90. A downstream end of the intake passage 90 is connected to the engine 92 of the vehicle. The air having flowed through the intake passage 90 flows into the engine 92.

The controller 100 of the evaporated fuel processing device 1 includes, for example, a CPU (not shown) and a memory 102 (such as ROM, RAM, etc.) and is configured to execute predetermined control and processes based on a predetermined program. The controller 100 may also be called an ECU (engine control unit). The control and processes executed by the controller 100 will be described later. An ignition switch 105 (hereinbelow termed "IG switch") for turning the engine 92 of the vehicle on and off is connected to the controller 100.

(Operation of Evaporated Fuel Processing Device 1)

(Adsorbing Process)

Next, operation of the evaporated fuel processing device 1 will be described. Firstly, an adsorbing process in which the evaporated fuel is adsorbed in the canister 40 will be described. Here, how the evaporated fuel processing device 1 operates when the closing valve 12 on the vapor passage 71 and the open air valve 16 on the open air passage 72 are both in the opened state will be described. In the evaporated fuel processing device 1, the gas containing the evaporated fuel generated from the fuel f in the fuel tank 30 flows from the fuel tank 30 into the vapor passage 71. The gas containing the evaporated fuel having flowed into the vapor passage 71 flows through the closing valve 12 in the opened state and then flows to a downstream portion of the vapor passage 71. After this, the gas containing the evaporated fuel having flowed through the vapor passage 71 flows into the first chamber 41 in the canister body 50 through the tank port 44 of the canister 40. When the closing valve 12 is in the closed state, the flow of the gas is cut off in the vapor passage 71.

The gas containing the evaporated fuel having flowed from the vapor passage 71 into the first chamber 41 flows through the first adsorbent 10 housed in the first chamber 41 into the intermediate chamber 47. While the gas containing the evaporated fuel is flowing through the first adsorbent 10, the first adsorbent 10 adsorbs a part of the evaporated fuel in the gas. The evaporated fuel is adsorbed on the active carbon constituting the first adsorbent 10. The evaporated fuel that was not adsorbed by the active carbon flows from the first chamber 41 into the intermediate chamber 47.

The gas containing the evaporated fuel having flowed into the intermediate chamber 47 through the first adsorbent 10 flows into the second chamber 42. The gas containing the evaporated fuel having flowed into the second chamber 42 flows through the second adsorbent 20 housed in the second chamber 42 into the open air passage 72 through the open air port 45. While the gas containing the evaporated fuel is flowing through the second adsorbent 20, the second adsorbent 20 adsorbs a part of the evaporated fuel in the gas. The evaporated fuel is adsorbed on the porous metal complex constituting the second adsorbent 20. The evaporated fuel that was not adsorbed by the porous metal complex flows from the second chamber 42 into the open air passage 72.

The gas containing the evaporated fuel having flowed into the open air passage 72 through the second adsorbent 20 is discharged into the open air. The evaporated fuel that was not adsorbed by the first adsorbent 10 (e.g., active carbon) nor the second adsorbent 20 (e.g., porous metal complex) is discharged to the open air.

(Desorbing Process)

Next, a desorbing process in which the evaporated fuel is desorbed from the canister 40 will be described. In the evaporated fuel processing device 1, gas can flow through the purge passage 73 when the purge valve 74 on the purge passage 73 is in the opened state. Further, when the engine 92 of the vehicle in which the evaporated fuel processing device 1 is mounted starts to operate, air in the intake passage 90 is suctioned into the engine 92 and a negative pressure is applied in the intake passage 90. Thereby, the gas flows from the purge passage 73 into the intake passage 90. Along with this, air from the open air flows into the open air passage 72. The air having flowed into the open air passage 72 flows into the second chamber 42 in the casing body 50 through the open air port 45 of the canister 40. The air having flowed into the second chamber 42 flows through the second adsorbent 20 housed in the second chamber 42 into the intermediate chamber 47. While the air is flowing through the second adsorbent 20, the evaporated fuel adsorbed on the second adsorbent 20 is desorbed from the second adsorbent 20 into the air. That is, the evaporated fuel is purged. The air containing the purged evaporated fuel flows from the second chamber 42 into the intermediate chamber 47.

The air containing the evaporated fuel having flowed into the intermediate chamber 47 flows into the first chamber 41. The air having flowed into the first chamber 41 flows through the first adsorbent 10 housed in the first chamber 41 into the purge passage 73 through the purge port 46. While the air is flowing through the first adsorbent 10, the evaporated fuel adsorbed on the first adsorbent 10 is desorbed from the first adsorbent 10 to the air. That is, the evaporated fuel is purged. The air containing the purged evaporated fuel flows from the first chamber 41 into the purge passage 73.

The air containing the evaporated fuel having flowed into the purge passage 73 flows through the purge passage 73 into the intake passage 90. The air containing the evaporated fuel having flowed into the intake passage 90 is suctioned into the engine 92.

Figure 3:
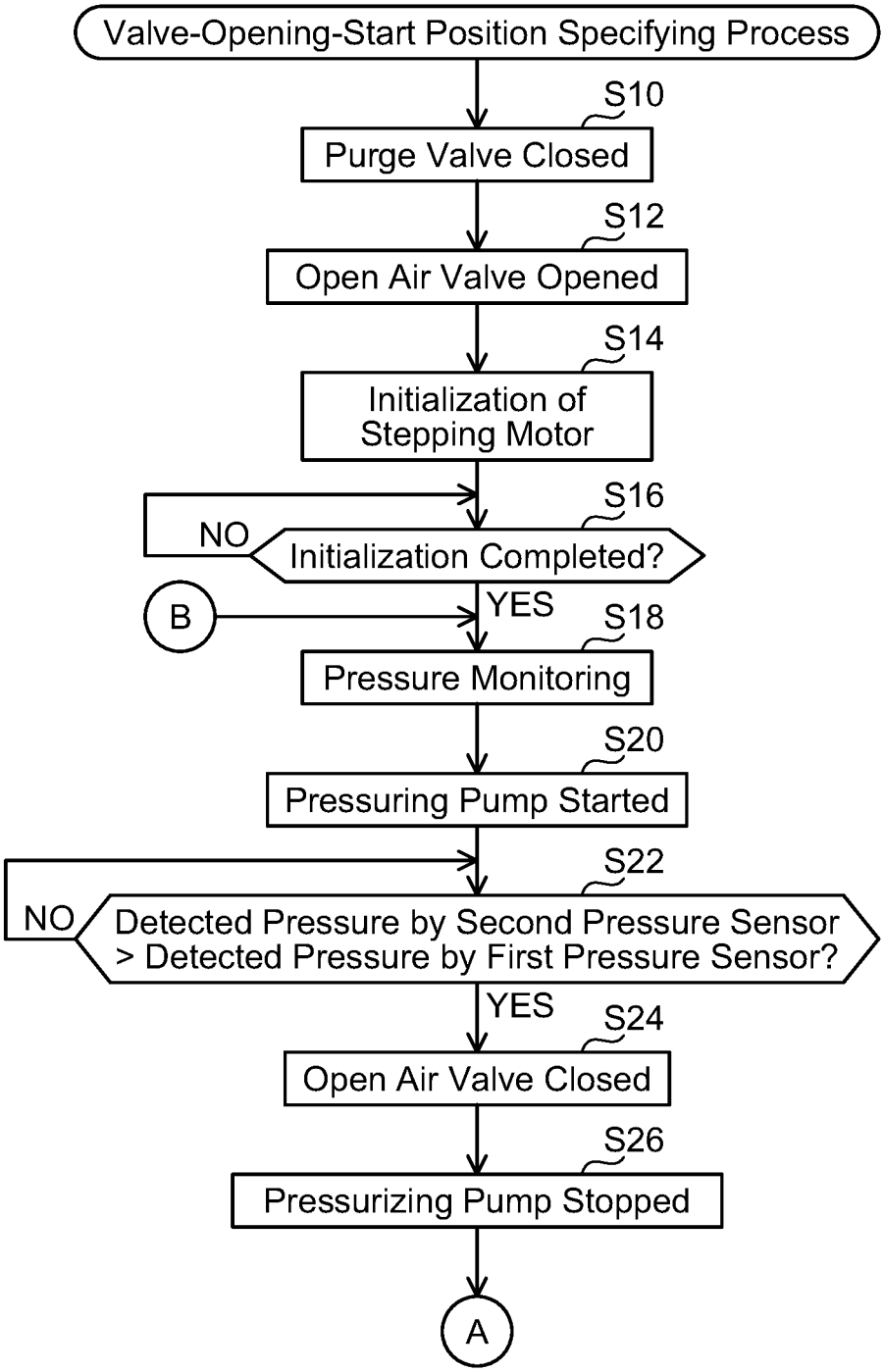
FIG. 3 is a flowchart (1) of a valve-opening-start position specifying process according to the embodiment.

(Valve-Opening-Start Position Specifying Process; FIG. 3)

Figure 4:
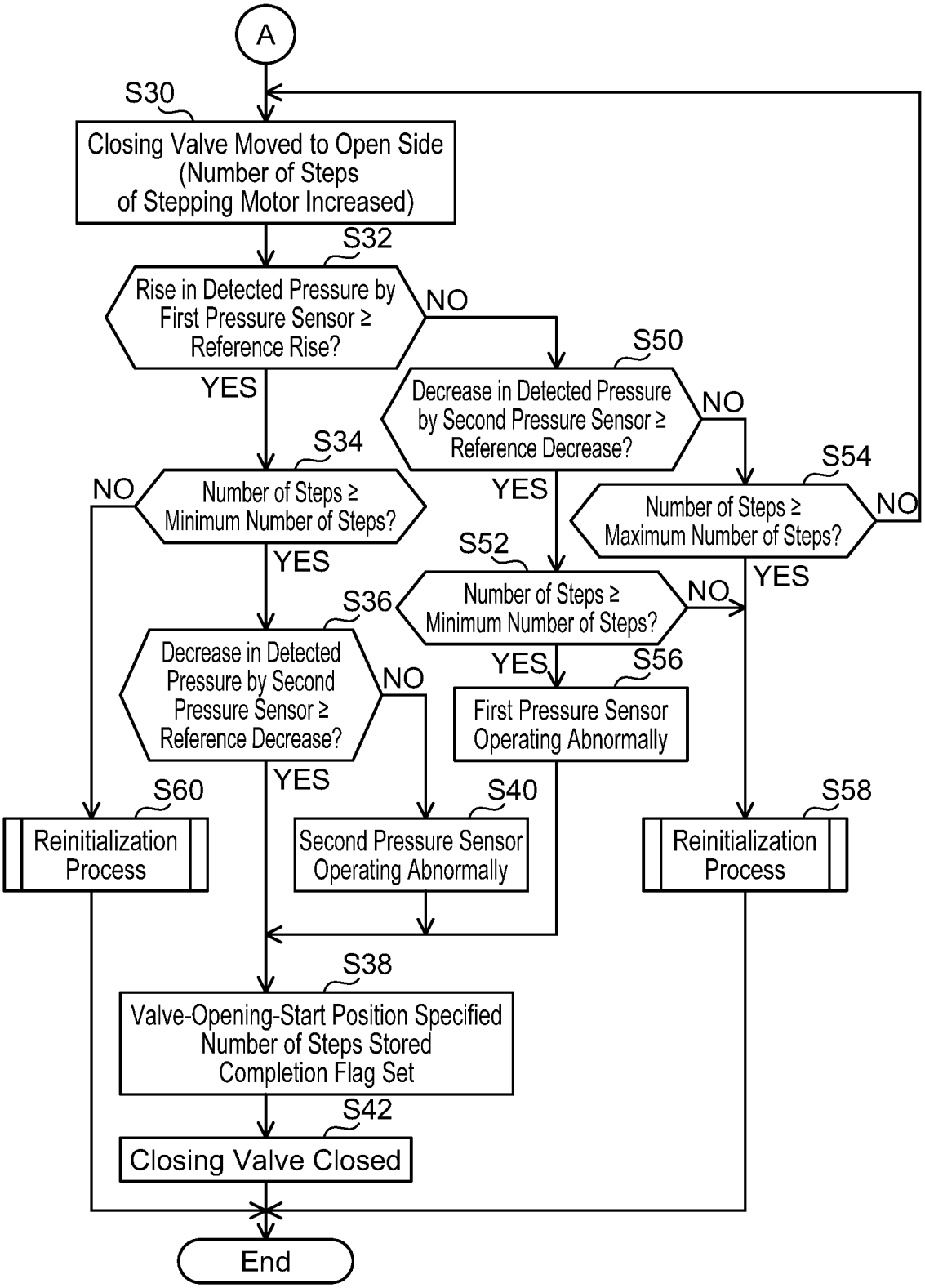
FIG. 4 is a flowchart (2) of the valve-opening-start position specifying process according to the embodiment.

Next, a valve-opening-start position specifying process executed by the evaporated fuel processing device 1 will be described. In the valve-opening-start position specifying process, a valve-opening-start position where the closing valve 12 on the vapor passage 71 transitions from the closed state to the opened state can be specified. FIGS. 3 and 4 are flowcharts of the valve-opening-start position specifying process. The valve-opening-start position specifying process is started, for example, when the IG switch 105 of the vehicle in which the evaporated fuel processing device 1 is mounted is turned on. The IG switch 105 is turned on, for example, when a start button of the engine 92 is pressed by a driver of the vehicle.

As shown in FIG. 3, in S10 of the valve-opening-start position specifying process, the controller 100 brings the purge valve 74 on the purge passage 73 into the closed state. Then, in S12, the controller 100 brings the open air valve 16 on the open air passage 72 into the opened state.

In S14, the controller 100 executes initialization of the stepping motor 14, which actuates the closing valve 12. The initialization of the stepping motor 14 is a process of setting an initial value of the stepping motor 14 by decreasing the number of steps of the stepping motor 14 (i.e., by rotating the stepping motor 14 in a negative direction). As a result of the initialization of the stepping motor 14, the initial value of the stepping motor 14 is set. Further, as a result of the initialization of the stepping motor 14, the closing valve 12 moves to the closing side and transitions to the closed state.

In S16, the controller 100 determines whether the initialization of the stepping motor 14 is completed. Whether the initialization is completed or not is determined, for example, based on whether the number of steps of the stepping motor 14 has been sufficiently decreased to bring the closing valve 12 into the closed state. If the initialization is completed, the controller 100 determines YES in S16 and proceeds to S18. If not, the controller 100 determines NO and waits.

In S18, the controller 100 monitors the pressure detected by the first pressure sensor 31 disposed at the fuel tank 30 (i.e., the pressure in the fuel tank 30). The controller 100 also monitors the pressure detected by the second pressure sensor 32 on the open air passage 72 (i.e., the pressure in the open air passage 72). By monitoring the detected pressure by the second pressure sensor 32, the controller 100 indirectly monitors the pressure in the vapor passage 71 downstream of the closing valve 12.

In S20, the controller 100 starts the pressurizing pump 2 on the open air passage 72. When the pressurizing pump 2 is started, the air from the open air is pumped to the canister 40. Gas in the open air passage 72 is thereby pressurized toward the canister 40. Along with this, the gas in the canister 40 is also pressurized toward the purge passage 73 and the vapor passage 71. Since the purge valve 74 on the purge passage 73 is in the closed state, the gas in the purge passage 73 does not flow through the purge valve 74. Further, when the closing valve 12 on the vapor passage 71 is in the closed state, the gas in the vapor passage 71 does not flow through the closing valve 12. When the closing valve 12 is in the opened state, the gas in the vapor passage 71 flows through the closing valve 12.

In S22, the controller 100 determines whether the detected pressure by the second pressure sensor 32 is higher than the detected pressure by the first pressure sensor 31. If the detected pressure by the second pressure sensor 32 is higher than the detected pressure by the first pressure sensor 31, the controller 100 determines YES in S22 and proceeds to S24. If not, the controller 100 determines NO and waits. The controller 100 increases the output of the pressurizing pump 2 until the detected pressure by the second pressure sensor 32 becomes higher than the detected pressure by the first pressure sensor 31.

In S24 following YES in S22, the controller 100 brings the open air valve 16 into the closed state. Thereby, the pressure in a space defined by the open air valve 16, the purge valve 74, and the closing valve 12 is maintained.

Then, in S26, the controller 100 stops the pressurizing pump 2. When the process of S26 is completed, the controller 100 proceeds to S30 through "A" (see FIG. 4).

As shown in FIG. 4, in S30, the controller 100 causes the closing valve 12, which is configured to open and close the vapor passage 71, to move toward the open side. More specifically, the controller 100 increases the number of steps of the stepping motor 14, which actuates the closing valve 12, by one step, for example. When the number of steps of the stepping motor 14 is increased, for example, by one step, the closing valve 12 is moved toward the open side by one step, accordingly. In the course of the number of steps of the stepping motor 14 being increased, the closing valve 12 transitions from the closed state to the opened state at a certain point. That is, the closing valve 12 reaches the valve-opening-start position.

Once the closing valve 12 has reached the valve-opening-start position in the process of S30, the gas in the vapor passage 71 downstream of the closing valve 12 flows through the closing valve 12 into the fuel tank 30. Thereby, the pressure in the fuel tank 30 is raised and the detected pressure by the first pressure sensor 31 is raised. Further, once the closing valve 12 has reached the valve-opening-start position in the process of S30, the pressure in the vapor passage 71 downstream of the closing valve 12 decreases. Thereby, the pressure in the open air passage 72 decreases and the detected pressure by the second pressure sensor 32 decreases. On the other hand, when the closing valve 12 is still in the closed state even though it has started to move to the open side, the detected pressure by the first pressure sensor 31 does not rise and the detected pressure by the second pressure sensor 32 does not decrease.

In S32, the controller 100 determines, based on the information obtained from the first pressure sensor 31, whether a rise in the detected pressure by the first pressure sensor 31 is no less than a reference rise. That is, the controller 100 determines whether a rise in the pressure in the fuel tank 30 is no less than the reference rise. If the rise in the detected pressure by the first pressure sensor 31 is equal to or greater than the reference rise, the controller 100 determines YES in S32 and proceeds to S34. If not (if the rise in the detected pressure is less than the reference rise), the controller 100 determines NO and proceeds to S50. The reference rise used in S32 is a pressure rise by which the transition of the closing valve 12 from the closed state to the opened state can be recognized.

In S34 following YES in S32, the controller 100 determines whether the present number of steps of the stepping motor 14 is no less than a predetermined minimum number of steps. More specifically, the controller 100 determines whether the number of steps of the stepping motor 14 from the initial value after the initialization of the stepping motor 14 to the present number is no less than the minimum number of steps (e.g., four steps). If the present number of steps is equal to or greater than the minimum number of steps, the controller 100 determines YES in S34 and proceeds to S36. If not, the controller 100 determines NO and proceeds to S60. In S60, the controller 100 executes a reinitialization process to be described later.

In S36 following YES in S34, the controller 100 determines, based on the information obtained from the second pressure sensor 32, whether a decrease in the detected pressure by the second pressure sensor 32 is no less than a reference decrease. That is, the controller 100 determines whether a decrease in the pressure in the open air passage 72 is no less than the reference decrease. The controller 100 thus indirectly determines whether a decrease in the pressure in the vapor passage 71 downstream of the closing valve 12 is no less than the reference decrease. If the decrease in the detected pressure by the second pressure sensor 32 is equal to or greater than the reference decrease, the controller 100 determines YES in S36 and proceeds to S38. If not (if the decrease in the detected pressure is less than the reference decrease), the controller 100 determines NO and proceeds to S40. The reference decrease used in S36 is a pressure decrease by which the transition of the closing valve 12 from the closed state to the opened state can be recognized.

In S40 following NO in S36, the controller 100 determines that the second pressure sensor 32 is operating abnormally. If the second pressure sensor 32 is operating normally, the decrease in the detected pressure by the second pressure sensor 32 is supposed to become equal to or greater than the reference decrease (YES in S36) when the closing valve 12 is brought to the opened state in the process of S30. If the decrease in the detected pressure by the second pressure sensor 32 does not change as such (NO in S36), it can be determined that the second pressure sensor 32 is operating abnormally. The controller 100 determines that the second pressure sensor 32 is operating abnormally when the detected pressure by the second pressure sensor 32 does not decrease (NO in S36) even though the detected pressure by the first pressure sensor 31 rises (YES in S32).

In S38 following YES in S36, the controller 100 specifies the valve-opening-start position of the closing valve 12 based on the present number of steps of the stepping motor 14. More specifically, the controller 100 specifies the present position of the closing valve 12 in accordance with the present number of steps of the stepping motor 14 and specifies that position as the valve-opening-start position. The valve-opening-start position of the closing valve 12 is a position at which the closing valve 12 transitions from the closed state to the opened state. Once the closing valve 12 has reached the valve-opening-start position, the rise in the detected pressure by the first pressure sensor 31 becomes equal to or greater than the reference rise (YES in S32) and the decrease in the detected pressure by the second pressure sensor 32 becomes equal to or greater than the reference decrease (YES in S36). The controller 100 specifies the position of the closing valve 12 at such timing as the valve-opening-start position.

Further, in S38, the controller 100 stores the present number of steps of the stepping motor 14 in the memory 102. In a variant, the controller 100 may store the number of steps immediately before the present number of steps (that is, one step before the present number of steps) in the memory 102. The controller 100 may store the number of steps immediately before the closing valve 12 transitions from the closed state to the opened state (that is, immediately before the valve-opening-start position) in the memory 102. In S38, the controller 100 also sets a completion flag indicating that the specification for the valve-opening-start position of the closing valve 12 has been completed and stores the flag in the memory 102.

In S42, the controller 100 causes the closing valve 12 to move toward the closing side to bring the closing valve 12 into the closed state. More specifically, the controller 100 decreases the number of steps of the stepping motor 14. As the number of steps of the stepping motor 14 is decreased, the closing valve 12 moves toward the closing side. When the process of S42 is completed, the controller 100 ends the valve-opening-start position specifying process.

In S50 following NO in S32, the controller 100 determines, based on the information obtained from the second pressure sensor 32, whether the decrease in the detected pressure by the second pressure sensor 32 is no less than the reference decrease. The process of S50 is the same as the process of S36 which has been described above, and thus detailed description thereon is omitted. The controller 100 proceeds to S52 if determining YES in S50, while it proceeds to S54 if determining NO in S50.

In S52 following YES in S50, the controller 100 determines whether the present number of steps of the stepping motor 14 is no less than the predetermined minimum number of steps. The process of S52 is the same as the process of S34 which has been described above, and thus detailed description thereon is omitted. The controller 100 proceeds to S56 if determining YES in S52, while it proceeds to S58 if determining NO in S52.

In S56 following YES in S52, the controller 100 determines that the first pressure sensor 31 is operating abnormally. If the first pressure sensor 31 is operating normally, the rise in the detected pressure by the first pressure sensor 31 is supposed to become equal to or greater than the reference rise (YES in S32) when the closing valve 12 is brought into the opened state in S30. If the rise in the detected pressure by the first pressure sensor 31 does not change so (NO in S32), it can be determined that the first pressure sensor 31 is operating abnormally. The controller 100 determines that the first pressure sensor 31 is operating abnormally when the detected pressure by the second pressure sensor 32 decreases (YES in S50) without the detected pressure by the first pressure sensor 31 rising. When the process of S56 is completed, the controller 100 proceeds to S38.

In S54 following NO in S50, the controller 100 determines whether the present number of steps of the stepping motor 14 is no less than a predetermined maximum number of steps. More specifically, the controller 100 determines whether the number of steps of the stepping motor 14 from the initial value after the initialization of the stepping motor 14 to the present number is no less than the maximum number of steps (e.g., twenty steps). If the present number of steps is equal to or greater than the maximum number of steps, the controller 100 determines YES in S54 and proceeds to S58. If not, the controller 100 determines NO and returns to S30. In S58, the controller 100 executes the reinitialization process to be described later.

Figure 5:
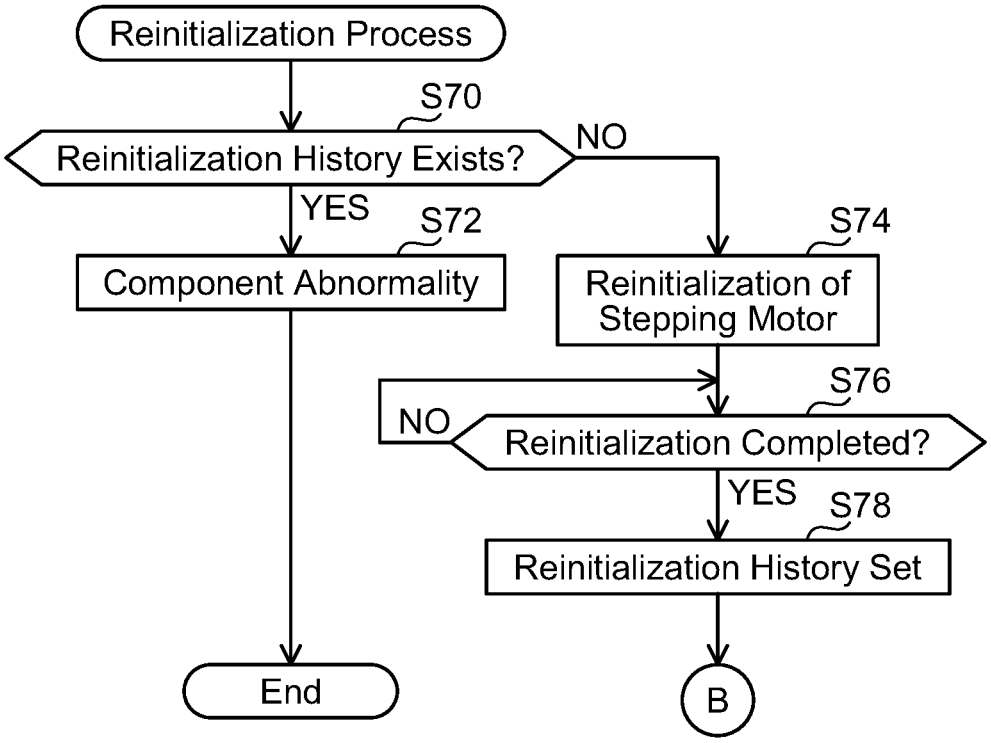
FIG. 5 is a flowchart of a reinitialization process according to the embodiment.

(Reinitialization Process; FIG. 5)

Next, the reinitialization process will be described. FIG. 5 is a flowchart of the reinitialization process. As shown in FIG. 5, in S70 of the reinitialization process, the controller 100 determines whether a reinitialization history is present in the memory 102. The reinitialization history is information indicating that reinitialization of the stepping motor 14 has been executed before. If the reinitialization history is present in the memory 102, the controller 100 determines YES in S70 and proceeds to S72. If the reinitialization history is not present, the controller 100 determines NO and proceeds to S74.

In S72, the controller 100 determines that an abnormality is occurring in a component of the evaporated fuel processing device 1. For example, it determines that an abnormality is occurring in the closing valve 12. Alternatively, it determines that an abnormality is occurring in the first pressure sensor 31 or the second pressure sensor 32. When the process of S72 is completed, the controller 100 ends the reinitialization process as well as the valve-opening-start position specifying process.

In S74 following NO in S70, the controller 100 executes the reinitialization of the stepping motor 14. When the reinitialization of the stepping motor 14 is executed, the initial value of the stepping motor 14 is set again. Further, when the reinitialization of the stepping motor 14 is executed, the closing valve 12 is moved toward the closing side again into the closed state.

In S76, the controller 100 determines whether the reinitialization of the stepping motor 14 has been completed. If the reinitialization has been completed, the controller 100 determines YES in S76 and proceeds to S78. If not, the controller 100 determines NO and waits.

In S78, the controller 100 sets reinitialization history and stores it in the memory 102. The reinitialization history is information indicating that the reinitialization of the stepping motor 14 has been executed. When the process of S78 is completed, the controller 100 proceeds to "B" and executes the process of S18 in the valve-opening-start position specifying process shown in FIG. 3. The reinitialization process has been described.

The evaporated fuel processing device 1 according to the embodiment has been described above. As apparent from the above description, the evaporated fuel processing device 1 includes the vapor passage 71 through which the evaporated fuel generated from the fuel in the fuel tank 30 flows; the closing valve 12 configured to open and close the vapor passage 71; and the pressurizing pump 2 configured to pressurize the gas in the vapor passage 71 downstream of the closing valve 12 toward the closing valve 12. Further, the evaporated fuel processing device 1 includes the first pressure sensor 31 configured to detect the pressure in the fuel tank 30 and the second pressure sensor 32 configured to indirectly detect the pressure in the vapor passage 71 downstream of the closing valve 12. In the case where the closing valve 12 moves toward the open side in the closed state with the pressurizing pump 2 pressurizing the gas in the vapor passage 71 downstream of the closing valve 12 toward the closing valve 12, the controller 100 specifies the valve-opening-start position where the closing valve 12 transitions from the closed state to the opened state based on the detected pressure by the first pressure sensor 31 and/or the detected pressure by the second pressure sensor 32 (see YES in S32, YES in S36 or S50, S38 of FIG. 4).

When the closing valve 12 transitions from the closed state to the opened state with the pressurizing pump 2 pressurizing the gas in the vapor passage 71 downstream of the closing valve 12 toward the closing valve 12, the gas in the vapor passage 71 downstream of the closing valve 12 flows through the closing valve 12 into the fuel tank 30. As a result, the pressure in the fuel tank 30 rises and the pressure in the vapor passage 71 downstream of the closing valve 12 decreases. Thus, if the evaporated fuel processing device 1 includes the first pressure sensor 31, the detected pressure by the first pressure sensor 31 rises. If the evaporated fuel processing device 1 includes the second pressure sensor 32, the detected pressure by the second pressure sensor 32 decreases. The controller 100 specifies the valve-opening-start position of the closing valve 12 based on the detected pressure by the first pressure sensor 31 and/or the detected pressure by the second pressure sensor 32. The controller 100 specifies, as the valve-opening-start position, a position of the closing valve 12 at the timing when the rise in the detected pressure by the first pressure sensor 31 becomes equal to or greater than the reference rise and/or when the decrease in the detected pressure by the second pressure sensor 32 becomes equal to or greater than the reference decrease. In the evaporated fuel processing device 1 as described, the pressurizing pump 2 is pressurizing the gas in the vapor passage 71 downstream of the closing valve 12 toward the closing valve 12 when the controller 100 specifies the valve-opening-start position, and thus a flow of the evaporated fuel from the upstream side of the closing valve 12 (fuel tank 30 side) into the downstream side thereof can be reduced. This configuration is particularly effective when an outflow of the evaporated fuel is restricted by a law or regulation, for example.

In the evaporated fuel processing device 1, the controller 100 determines whether the first pressure sensor 31 is operating abnormally and whether the second pressure sensor 32 is operating abnormally based on the detected pressure by the first pressure sensor 31 and the detected pressure by the second pressure sensor 32 (see S40, S56 in FIG. 4). According to this configuration, whether the first pressure sensor 31 is operating abnormally and whether the second pressure sensor 32 is operating abnormally can be determined by using the configuration used to specify the valve-opening-start position of the closing valve 12. For example, when the detected pressure by the second pressure sensor 32 does not decrease even though the detected pressure by the first pressure sensor 31 rises upon the transition of the closing valve 12 from the closed state to the opened state, it can be determined that the second pressure sensor 32 is operating abnormally. Whether the first pressure sensor is operating abnormally can be determined similarly.

The controller 100 specifies the valve-opening-start position based on the number of steps of the stepping motor 14. According to this configuration, the valve-opening-start position of the closing valve 12 can be accurately specified by specifying it based on the number of steps of the stepping motor 14.

While an embodiment has been described above, specific aspects are not limited to the above embodiment. In the following description, elements that are identical to those described in the foregoing description will be given the same reference signs and description thereof will be omitted.

(First Variant) In a first variant, the controller 100 may rotate the stepping motor 14 by a plurality of steps at a time when causing the closing valve 12 to move toward the open side in S30 of the valve-opening-start position specifying process (see FIG. 4). For example, the controller 100 may rotate the stepping motor 14 by two steps at a time.

Figure 6:
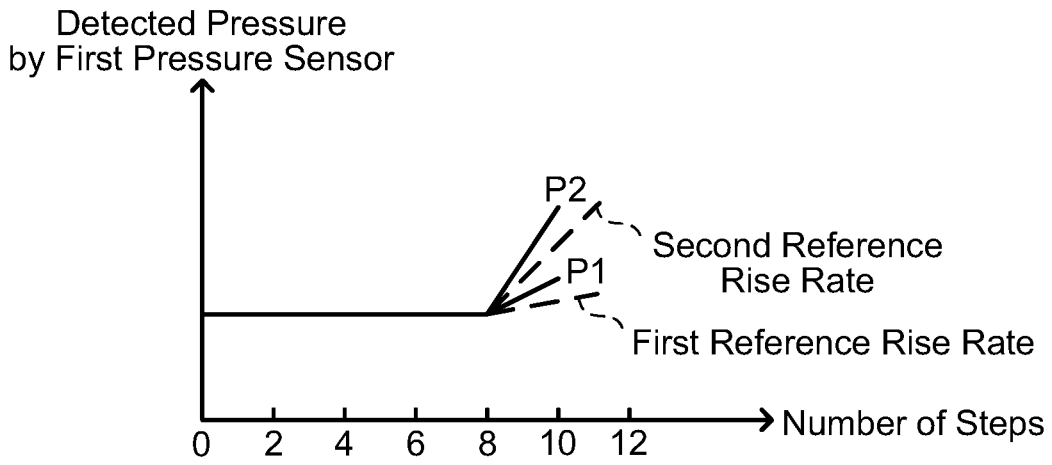
FIG. 6 shows an exemplary relationship between the number of steps and detected pressures by a first pressure sensor.

Further, in the first variant, the controller 100 may specify the valve-opening-start position of the closing valve 12 in S38 (see FIG. 4) based on a rise rate of the detected pressure by the first pressure sensor 31. For example, as shown in FIG. 6, in the case where the rise rate of the detected pressure by the first pressure sensor 31 is equal to or greater than a first reference rise rate and less than a second reference rise rate when the controller 100 rotates the stepping motor 14 by two steps at a time, the controller 100 specifies the valve-opening-start position of the closing valve 12 according to the present number of steps of the stepping motor 14. In the example shown in FIG. 6, in the case where the rise rate of the detected pressure by the first pressure sensor 31 is P1 when the controller 100 rotates the stepping motor 14 from step 8 to step 10, the controller 100 specifies, as the valve-opening-start position, a position of the closing valve 12 at the timing when the stepping motor 14 is at step 10. The rise rate of the detected pressure by the first pressure sensor 31 is a rise in the detected pressure by the first pressure sensor 31 corresponding to the number of steps of the stepping motor 14.

In the case where the rise rate of the detected pressure by the first pressure sensor 31 is equal to or greater than the second reference rise rate, the controller 100 specifies, as the valve-opening-start position, a position of the closing valve 12 corresponding to the number of steps immediately before (i.e., one step before) the present number of steps. In the example shown in FIG. 6, in the case where the rise rate of the detected pressure by the first pressure sensor 31 is P2 when the controller 100 rotates the stepping motor 14 from step 8 to step 10, the controller 100 specifies, as the valve-opening-start position, a position of the closing valve 12 at the timing when the stepping motor 14 is at step 9 (step (10-1)). In FIG. 6, the second reference rise rate is greater than the first reference rise rate.

Figure 7:
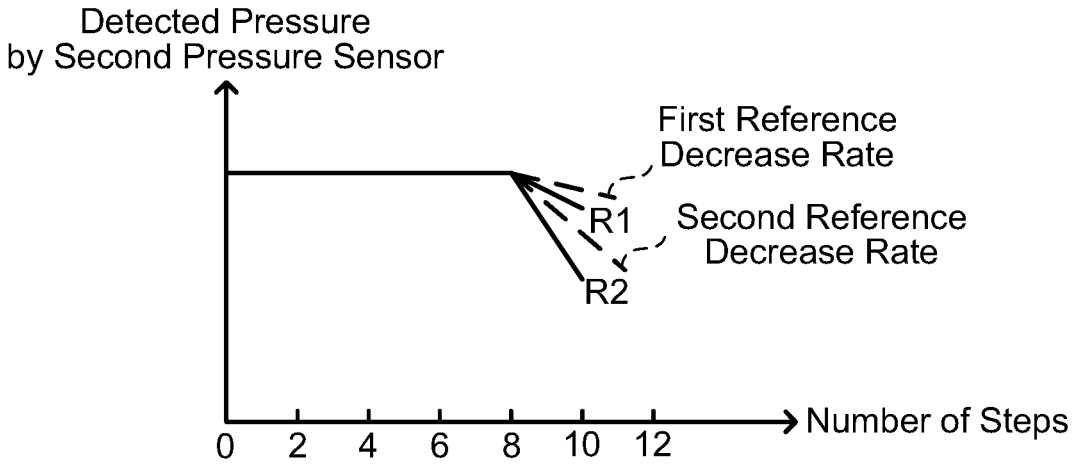
FIG. 7 shows an exemplary relationship between the number of steps and detected pressures by a second pressure sensor.

In the first variant, the controller 100 may specify the valve-opening-start position of the closing valve 12 based on a decrease rate of the detected pressure by the second pressure sensor 32 when specifying the valve-opening-start position of the closing valve 12 in S38 (see FIG. 4). For example, as shown in FIG. 7, in the case where the decrease rate of the detected pressure by the second pressure sensor 32 is equal to or greater than a first reference decrease rate and less than a second reference decrease rate when the controller 100 rotates the stepping motor 14 by two steps at a time, the controller 100 specifies the valve-opening-start position of the closing valve 12 according to the present number of steps of the stepping motor 14. In the example shown in FIG. 7, in the case where the decrease rate of the detected pressure by the second pressure sensor 32 is R1 when the controller 100 rotates the stepping motor 14 from step 8 to step 10, the controller 100 specifies, as the valve-opening-start position, a position of the closing valve 12 at the timing when the stepping motor 14 is at step 10. The decrease rate of the detected pressure by the second pressure sensor 32 is a decrease in the detected pressure by the second pressure sensor 32 corresponding to the number of steps of the stepping motor 14.

In the case where the decrease rate of the detected pressure by the second pressure sensor 32 is equal to or greater than the second reference decrease rate, the controller 100 specifies, as the valve-opening-start position, a position of the closing valve 12 corresponding to the number of steps immediately before (i.e., one step before) the present number of steps. In the example shown in FIG. 7, in the case where the decrease rate of the detected pressure by the second pressure sensor 32 is R2, the controller 100 specifies, as the valve-opening-start position, a position of the closing valve 12 at the timing when the stepping motor 14 is at step 9 (step (10-1)). In FIG. 7, the second reference decrease rate is greater than the first reference decrease rate.

The first variant has been described. As is apparent from the above description, the controller 100 specifies the valve-opening-start position of the closing valve 12 based on the rise rate of the detected pressure by the first pressure sensor 31 and/or the decrease rate of the detected pressure by the second pressure sensor 32 observed when the stepping motor 14 is rotated by a plurality of steps (e.g., two steps) at a time.

According to the configuration of the first variant, it is possible to make the closing valve 12 reach the valve-opening-start position earlier by rotating the stepping motor 14 by a plurality of steps. In this case as well, the valve-opening-start position of the closing valve 12 can be accurately specified. When the rise rate of the detected pressure by the first pressure sensor 31 is high, it can be determined that the closing valve 12 has reached the valve-opening-start position at one of first-half steps of the plurality of steps (e.g., at step 9 in the case where the stepping motor 14 is rotated from step 8 to step 10). When the rise rate of the detected pressure by the first pressure sensor 31 is low, it can be determined that the closing valve 12 has reached the valve-opening-start position at one of latter-half steps of the plurality of steps (e.g., at step 10 in the case where the stepping motor 14 is rotated from step 8 to step 10). When the decrease rate of the detected pressure by the second pressure sensor 32 is high and when it is low, determination on the valve-opening-start position can be made similarly.

(Second Variant)

In the first variant, the stepping motor 14 is rotated by two steps at a time when the controller 100 moves the closing valve 12 to the open side. In the second variant, the controller 100 may rotate the stepping motor 14 by three steps or more at a time.

In the first variant, in the case where the rise rate of the detected pressure by the first pressure sensor 31 is equal to or higher than the second reference rise rate, the controller 100 specifies, as the valve-opening-start position, the position of the closing valve 12 corresponding to the number of steps immediately before (i.e., one step before) the present number of steps. In the second variant, in the case where the rise rate of the detected pressure by the first pressure sensor 31 is equal to or higher than the second reference rise rate, the controller 100 may specify, as the valve-opening-start position, a position of the closing valve 12 corresponding to the number of steps a plurality of steps before (e.g., two steps before or three steps before) the present number of steps.

(Third Variant)

In a third variant, the controller 100 may move the closing valve 12 to the closing side by decreasing the number of steps of the stepping motor 14 by one step after having moved the closing valve 12 to the open side by rotating the stepping motor 14 by two steps at a time.

Figure 8:
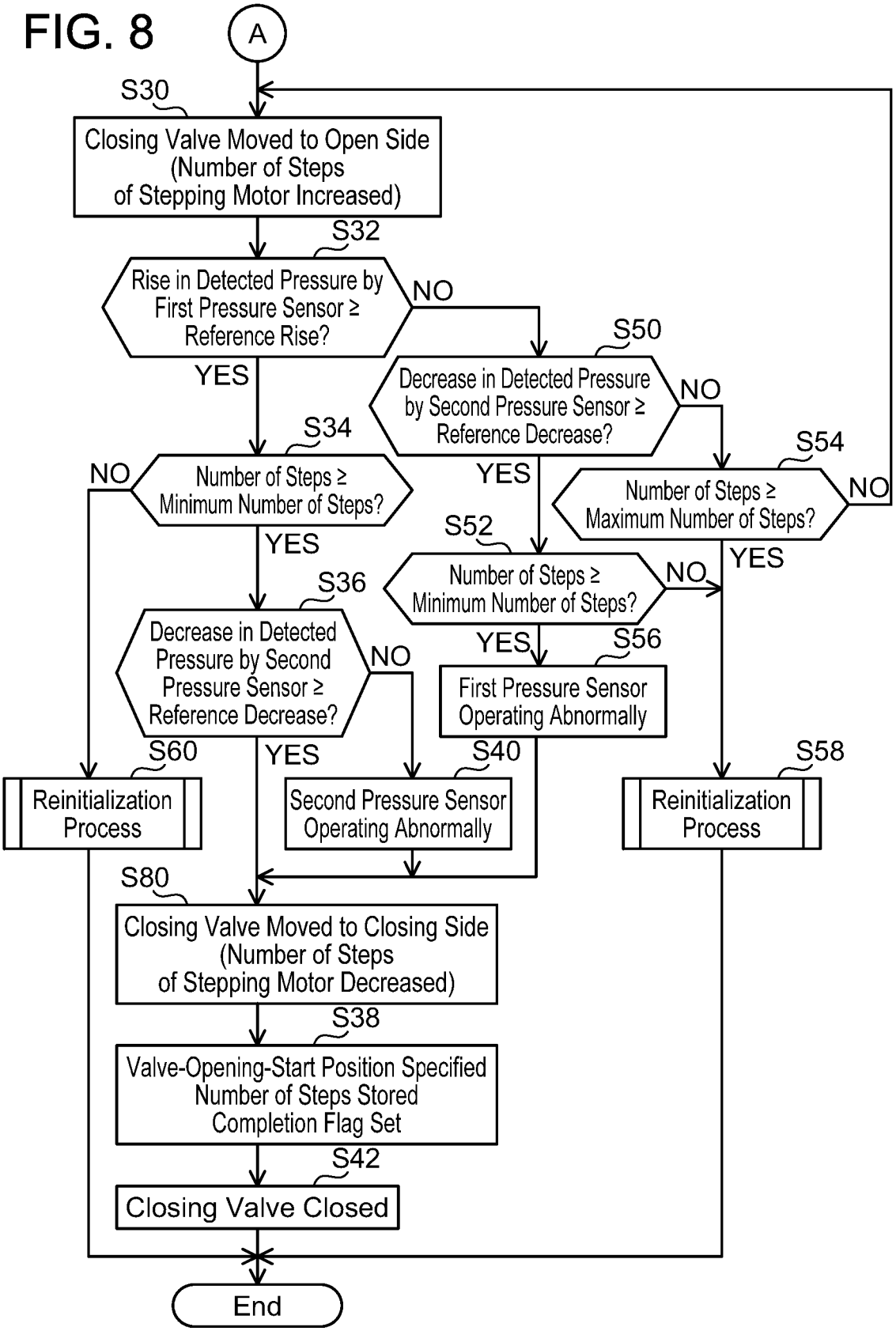
FIG. 8 is a flowchart of a valve-opening-start position specifying process according to a third variant.

FIG. 8 shows a flowchart of a valve-opening start position specifying process according to the third variant. In the third variant, the controller 100 rotates the stepping motor 14 by two steps at a time when moving the closing valve 12 to the open side in S30. Further, in the third variant, the controller 100 executes a process of S80 after determining YES in S36, as shown in FIG. 8.

In S80, the controller 100 moves the closing valve 12, which is configured to open and close the vapor passage 71, to the closing side. More specifically, the controller 100 decreases the number of steps of the stepping motor 14, which is configured to actuate the closing valve 12, by one step. When the number of steps of the stepping motor 14 is decreased by one step, the closing valve 12 is moved toward the closing side by one step, accordingly.

Figure 9:
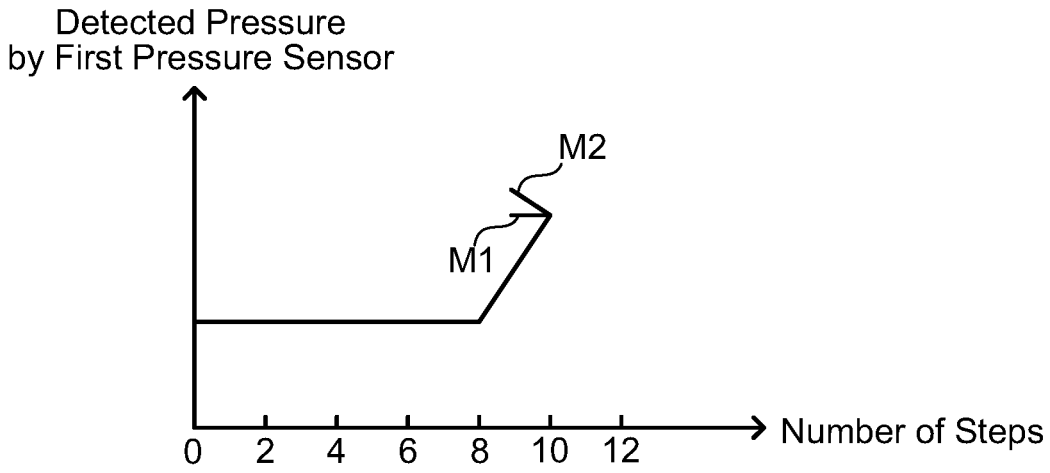
FIG. 9 shows an exemplary relationship between the number of steps and detected pressures by a first pressure sensor.

In S38 that follows, the controller 100 specifies the valve-opening-start position of the closing valve 12. More specifically, in the case where the detected pressure by the first pressure sensor 31 stops rising, as indicated by M1 in FIG. 9, by the closing valve 12 having been moved toward the closing side in S80, the controller 100 specifies, as the valve-opening-start position, a position of the closing valve 12 corresponding to the number of steps of the stepping motor 14 at the timing when it is decreased. In the example of FIG. 9, in the case where the detected pressure by the first pressure sensor 31 stops rising as indicated by M1 in FIG. 9 as a result of the controller 100 decreasing the number of steps from step 10 to step 9 after having rotated the stepping motor 14 from step 8 to step 10, the controller 100 specifies, as valve-opening-start position, a position of the closing valve 12 corresponding to the number of steps at the timing when it is decreased (step 10 in the example of FIG. 9).

The detected pressure by the first pressure sensor 31 stopping rising as indicated by M1 means that the closing valve 12 has been transitioned to the closed state and the pressure in the fuel tank 30 stops rising by the controller 100 having moved the closing valve 12 toward the closing side in S80. This state is a state in which the closing valve 12 has been transitioned to the closed state as a result of the controller 100 having decreased the number of steps of the stepping motor 14 by one step. Thus, in this case, the position of the closing valve 12 that corresponds to the number of steps of the stepping motor 14 at the timing when the controller 100 decreases it (step 10 in the example of FIG. 9) is the valve-opening-start position.

In the case where the detected pressure by the first pressure sensor 31 rises, as indicated by M2 in FIG. 9, even though the closing valve 12 has been moved toward the closing side in S80, the controller 100 specifies, as the valve-opening-start position, a position of the closing valve 12 corresponding to the number of steps that is immediately before the number of steps at the timing of the decrease. In the example of FIG. 9, in the case where the detected pressure by the first pressure sensor 31 rises as indicated by M2 in FIG. 9 even though the controller 100 decreases the number of steps from step 10 to step 9 after having rotated the stepping motor 14 from step 8 to step 10, the controller 100 specifies, as the valve-opening-start position, the position of the closing valve 12 corresponding to the number of steps that is immediately before the number of steps at the timing of the decrease (step 9 immediately before step 10 in the example of FIG. 9).

The detected pressure by the first pressure sensor 31 rising as indicated by M2 means that the closing valve 12 has not been transitioned to the closed state yet (the closing valve 12 is maintained in the opened state) and the pressure in the fuel tank 30 rises even though the controller 100 had moved the closing valve 12 toward the closing side. This state is a state in which the closing valve 12 has not been transitioned to the closed state (the closing valve 12 is maintained in the opened state) even though the controller 100 had decreased the number of steps of the stepping motor 14 by one step. Thus, in this case, the position of the closing valve 12 corresponding to the number of steps of the stepping motor 14 that is immediately before the number of steps at the timing when the controller 100 decreases it (step 9 in the example of FIG. 9) is the valve-opening-start position.

Figure 10:
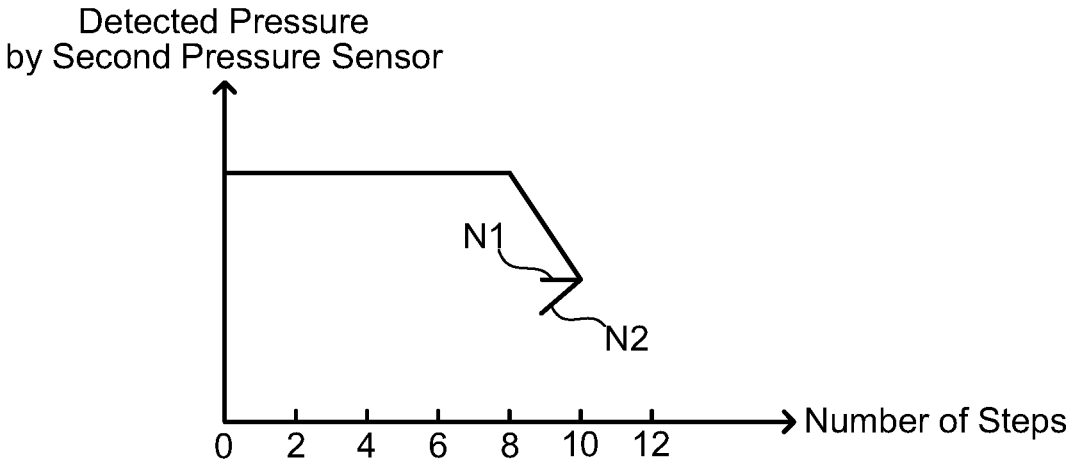
FIG. 10 shows an exemplary relationship between the number of steps and detected pressures by a second pressure sensor.

Further, in the third variant, the controller 100 can also specify the valve-opening-start position of the closing valve 12 based on the detected pressure by the second pressure sensor 32. More specifically, in the case where the detected pressure by the second pressure sensor 32 stops decreasing, as indicated by N1 in FIG. 10, by the closing valve 12 having been moved toward the closing side in S80, the controller 100 specifies, as the valve-opening-start position, a position of the closing valve 12 corresponding to the number of steps at the timing when it is decreased. In the example of FIG. 10, in the case where the detected pressure by the second pressure sensor 32 stops decreasing as indicated by N1 in FIG. 10 as a result of the controller 100 decreasing the number of steps from step 10 to step 9 after having rotated the stepping motor 14 from step 8 to step 10, the controller 100 specifies, as valve-opening-start position, a position of the closing valve 12 corresponding to the number of steps at the timing when it is decreased (step 10 in the example of FIG. 10).

The detected pressure by the second pressure sensor 32 stopping decreasing as indicated by N1 means that the closing valve 12 has been transitioned to the closed state and the pressure in the fuel tank 30 stops decreasing by the controller 100 having moved the closing valve 12 toward the closing side in S80. This state is a state in which the closing valve 12 has been transitioned to the closed state as a result of the controller 100 having decreased the number of steps of the stepping motor 14 by one step. Thus, in this case, the position of the closing valve 12 that corresponds to the number of steps of the stepping motor 14 at the timing when the controller 100 decreases it (step 10 in the example of FIG. 10) is the valve-opening-start position.

In the case where the detected pressure by the second pressure sensor 32 decreases, as indicated by N2 in FIG. 10, even though the closing valve 12 has been moved toward the closing side in S80, the controller 100 specifies, as the valve-opening-start position, a position of the closing valve 12 corresponding to the number of steps that is immediately before the number of steps at the timing of the decrease. In the example of FIG. 10, in the case where the detected pressure by the second pressure sensor 32 decreases as indicated by N2 in FIG. 10 even though the controller 100 decreases the number of steps from step 10 to step 9 after having rotated the stepping motor 14 from step 8 to step 10, the controller 100 specifies, as the valve-opening-start position, the position of the closing valve 12 corresponding to the number of steps that is immediately before the number of steps at the timing of the decrease (step 9 immediately before step 10 in the example of FIG. 10).

The detected pressure by the second pressure sensor 32 decreasing as indicated by N2 means that the closing valve 12 has not been transitioned to the closed state yet (the closing valve 12 is maintained in the opened state) and the pressure in the fuel tank 30 decreases even though the controller 100 had moved the closing valve 12 toward the closing side. This state is a state in which the closing valve 12 has not been transitioned to the closed state (the closing valve 12 is maintained in the opened state) even though the controller 100 had decreased the number of steps of the stepping motor 14 by one step. Thus, in this case, the position of the closing valve 12 corresponding to the number of steps of the stepping motor 14 that is immediately before the number of steps at the timing when the controller 100 decreases it (step 9 in the example of FIG. 10) is the valve-opening-start position.

According to the configuration of the third variant, it is possible to make the closing valve 12 reach the valve-opening-start position earlier by rotating the stepping motor 14 by a plurality of steps at a time. In this case as well, the valve-opening-start position of the closing valve 12 can be accurately specified.

(Fourth Variant)

In a fourth variant, the controller 100 may move the closing valve 12 toward the open side by rotating the stepping motor 14 by three steps or more at a time, and after that it may move the closing valve 12 toward the closing side by decreasing the number of steps of the stepping motor 14 by at least one step.

(Fifth Variant)

In the embodiment described above, the first pressure sensor 31 is disposed at the fuel tank 30, however, the first pressure sensor 31 may be disposed on the vapor passage 71 in a fifth variant. The first pressure sensor 31 may be disposed on the part of the vapor passage 71 upstream of the closing valve 12. The pressure in the part of the vapor passage 71 upstream of the closing valve 12 is substantially the same as the pressure in the fuel tank 30. The first pressure sensor 31 may indirectly detect the pressure in the fuel tank 30 by detecting the part of the vapor passage 71 upstream of the closing valve 12.

(Sixth Variant)

In the embodiment described above, the second pressure sensor 32 is disposed on the open air passage 72, however, the second pressure sensor 32 may be disposed on the vapor passage 71 in a sixth variant. The second pressure sensor 32 may be disposed on the part of the vapor passage 71 downstream of the closing valve 12. The second pressure sensor 32 may directly detect the pressure in the part of the vapor passage 71 downstream of the closing valve 12.

What is claimed is:

1. An evaporated fuel processing device comprising:

a fuel tank;

a vapor passage through which evaporated fuel generated from fuel in the fuel tank flows;

a closing valve configured to open and close the vapor passage;

a pressurizing pump configured to pressurize gas in the vapor passage downstream of the closing valve toward the closing valve;

a first pressure sensor configured to detect a pressure in the fuel tank directly or indirectly; and/or a second pressure sensor configured to detect a pressure in the vapor passage downstream of the closing valve directly or indirectly; and a controller, wherein gas in the vapor passage flows through the closing valve when the closing valve is in an opened state, and the gas in the vapor passage does not flow through the closing valve when the closing valve is in a closed state, and when the closing valve moves toward an open side in the closed state with the pressurizing pump pressurizing the gas in the vapor passage downstream of the closing valve toward the closing valve, the controller specifies a valve-opening-start position based on the pressure detected by the first pressure sensor and/or the pressure detected by the second pressure sensor, wherein the valve-opening-start position is a position where the closing valve transitions from the closed state to the opened state.

2. The evaporated fuel processing device according to claim 1, comprising the first pressure sensor and the second pressure sensor, wherein the controller determines whether the first pressure sensor is operating abnormally and/or whether the second pressure sensor is operating abnormally based on the pressure detected by the first pressure sensor and the pressure detected by the second pressure sensor.

3. The evaporated fuel processing device according to claim 1, further comprising a stepping motor configured to actuate the closing valve, wherein the controller specifies the valve-opening-start position of the closing valve based on a number of steps by which the stepping motor has rotated.

4. The evaporated fuel processing device according to claim 3, wherein the controller specifies the valve-opening-start position of the closing valve based on a rise rate of the pressure detected by the first pressure sensor and/or a decrease rate of the pressure detected by the second pressure sensor observed when the stepping motor is rotated by a plurality of steps at a time.

5. The evaporated fuel processing device according to claim 3, wherein the controller specifies the valve-opening-start position of the closing valve based on the pressure detected by the first pressure sensor and/or the pressure detected by the second pressure sensor observed when the number of steps by which the stepping motor has rotated is decreased by at least one step after the stepping motor has rotated by a plurality of steps at a time.

* * * * *